United States Patent [19]

Iwasaki et al.

[11] 4,226,912

[45] Oct. 7, 1980

[54] HEAT-SENSITIVE RECORDING MATERIAL

[75] Inventors: Hiroshi Iwasaki, Kawanishi; Takeshi Murakami, Osaka; Mitsuru Kondo, Hyogo, all of Japan

[73] Assignee: Kanzaki Paper Manufacturing Co., Ltd., Tokyo, Japan

[21] Appl. No.: 9,083

[22] Filed: Feb. 2, 1979

[30] Foreign Application Priority Data

Feb. 15, 1978 [JP] Japan ..... 53-16695

[51] Int. Cl.[2] ..... B41M 5/18

[52] U.S. Cl. ..... 428/411; 106/21; 282/27.5; 427/151; 428/307; 428/913; 428/914

[58] Field of Search ..... 106/21; 282/27.5; 260/335; 427/150, 151; 428/307, 411, 537, 913, 914, 511, 524, 530

[56] References Cited

U.S. PATENT DOCUMENTS

| | | | |
|---|---|---|---|
| 3,501,331 | 3/1970 | Kimura et al. | 428/307 |
| 3,669,711 | 6/1972 | Kimura et al. | 428/914 X |
| 3,825,432 | 7/1974 | Futaki et al. | 106/241 X |
| 3,825,561 | 7/1974 | Akamatsu et al. | 260/335 |
| 3,929,831 | 12/1975 | Garner et al. | 260/326.34 |

FOREIGN PATENT DOCUMENTS

| | | | |
|---|---|---|---|
| 1297596 | 11/1972 | United Kingdom | 282/27.5 |
| 1357244 | 6/1974 | United Kingdom | 282/27.5 |
| 1359422 | 7/1974 | United Kingdom | 282/27.5 |

*Primary Examiner*—Bruce H. Hess

*Attorney, Agent, or Firm*—Morgan, Finnegan, Pine, Foley & Lee

[57] ABSTRACT

The black color developing heat-sensitive recording material comprises a base sheet and a color developing layer formed on at least one surface of the base sheet, the color developing layer including colorless or light-colored chromogenic material and acceptor which is reactive with said chromogenic material to develop a black color. At least 60% by weight of the chromogenic material comprises at least two kinds of black color developing fluoran compounds having the eneral formula

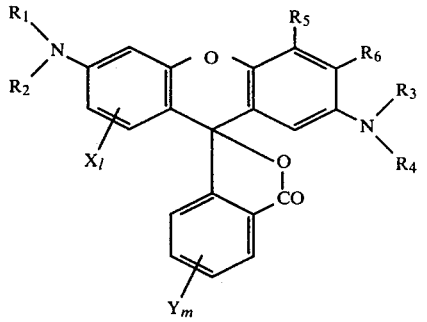

wherein $R_1$, $R_2$, $R_3$, $R_4$, $R_5$, $R_6$, $X_l$ and Ym are described hereinafter and the amount of each of said black color developing fluoran compounds is not larger than 90% by weight of the total amount of said black color developing fluoran compounds.

12 Claims, No Drawings

HEAT-SENSITIVE RECORDING MATERIAL

BACKGROUND OF THE INVENTION

This invention relates to a heat-sensitive recording material and particularly to a black color developing heat-sensitive recording material prevented from fading.

There has heretofore been known a heat-sensitive recording material which utilizes color reaction between a colorless or light-colored chromogenic material and an organic or inorganic acceptor, which the two components being thermally brought into contact with each other to produce a developed color image.

One of the essential requirements which such heat-sensitive recording material should meet is that the resulting record image be maintained for a long time without fading under the influence of external conditions, such as light, humidity and heat. The fading of the recording material will bring about a serious hindrance to the usefulness of such recording material. As for improvements in such respect, various investigations and proposals have been made since the development of heat-sensitive recording materials, but each improvement has been attended with new drawbacks, so that satisfactory results have not always been obtained. For example, Japan Kokai (Laid-Open Patent Publication) No. 149,353 of 1975 proposed a method in which a particular amine is added to the color developing layer in order to prevent the fading of the record image due to light. With this method, however, though improvements are observed from the standpoint of fading due to light, the fading tendency of the record image due to humidity and heat is rather increased, sometimes causing the complete loss of the record.

Further, Japan Patent Publication No. 1436 of 1976 proposes a method in which a phenol compound and a phenol resin are jointly used in order to prevent the fading of the record image. With this method, however, not only is the fading-preventive effect insufficient, but also unnecessary coloration, or the so-called "fogging", occurs during the manufacture or storage of the recording material. Since it occurs noticeably under the influence of high humidity and heat, the recording material, if placed under such conditions, would even lose its marketability.

The principal object of the invention is to provide a heat-sensitive recording material which is excellent in the long-term retention of a record image, free from the fading of the record image due to humidity and heat, free from fogging and substantially of uniform quality. Particularly, it provides a recording material aimed to prevent the fading of a record image, especially in the case of a black color developing type heat-sensitive recording material to which the fading of a record image is a vital drawback from the standpoint of practicability.

The above object can be achieved by a combined use of at least two special black color developing fluoran compounds having similar skeletons with an organic acceptor.

Heretofore, in these heat-sensitive recording materials, the mixed use of chromogenic materials having the same developed color hue has not been known or attempted. Still less has it been possible to anticipate that the mixed use, in a particular ratio, of special chromogenic materials having the same blackish hue would contribute to the retention stability of a record image.

SUMMARY OF THE INVENTION

The black color developing heat-sensitive recording material according to the invention comprises a base sheet and a color developing layer formed on at least one surface of the base sheet. The color developing layer includes colorless or light-colored chromogenic material and acceptor which is reactive with said chromogenic material to develop a black color. At least 60% by weight of the chromogenic material comprises at least two kinds of black color developing fluoran compounds having the general formula

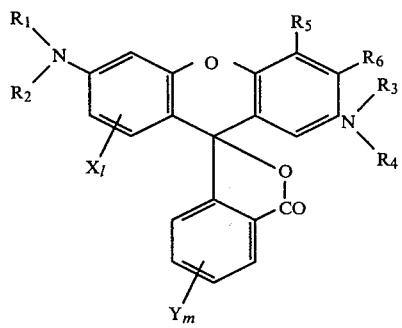

(I)

wherein each $R_1$, $R_2$, $R_3$ and $R_4$ represents hydrogen, alkyl, alicyclic, aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, $R_1$ may cooperate with $R_2$ to form a heterocyclic ring and $R_3$ may cooperate with $R_4$ to form a heterocyclic ring; $R_5$ represents hydrogen, halogen, alkyl, halogenated alkyl, cyanoalkyl, alkoxyl, aralkyl or substituted amino; $R_6$ represents hydrogen, halogen, alkyl, halogenated alkyl, cyanoalkyl or aralkyl; $R_5$ may cooperate with $R_6$ to form an aromatic ring; X represents halogen, alkyl, halogenated alkyl, cyanoalkyl or alkoxyl; Y represents halogen, alkyl, alicyclic halogenated alkyl, cyanoalkyl, alkoxyl, aralkyl, aryl, acyl, amino, substituted amino or nitro; Y may form an aromatic ring together with the benzene ring to which Y is attached; l is zero or an integer of 1 to 2 and m is zero or an integer of 1 to 4. The amount of each of said black color developing fluoran compounds is not larger than 90% by weight of the total amount of said black color developing fluoran compounds.

DETAILED DESCRIPTION OF THE INVENTION

According to the invention it is imperative to use at least two of the black color developing chromogenic materials (hereinafter referred to as merely "dyes") represented by the above mentioned general formula (I). The composition ratio of such dyes is very important. More particularly, if the amount of any one such dyes exceeds 90% by weight of the total amount of such dyes described, the desired effect of the invention would not be obtained. Therefore, the amount of each of such dyes as described should be less than 90% by weight, preferably less than 70% by weight and more preferably less than 60% by weight of the total amount of such dyes as described. However, use of each of the dyes in an extremely small amount necessarily involves increasing the kinds of different dyes, thus making the manufacturing process complicated. It is preferable, therefore, that the amount of each of such dyes as described is greater than 10% by weight of the total amount of such dyes as described. The reason why such composition ratio as specified is important to obtained good results is not clear, but it is assumed that it would be owing to the affinity between the different dyes having similar skeletons.

Black color developing fluoran compounds used in the invention are basic dyes which have the basic skeleton represented by the above mentioned general formula (I) and which exhibit a high strength dark color of the multi-color type, such as pure black, green black, blue black, red black and black brown. Particularly preferably used are black color developing fluoran compounds having the basic skeleton represented by any of the following general formulae (II) and (III):

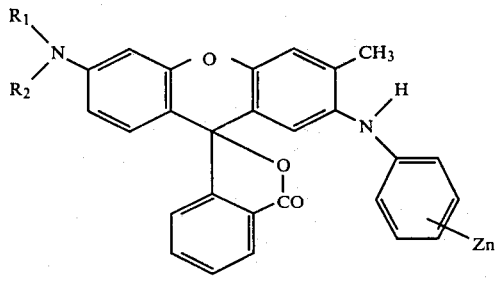

(II)

wherein each of $R_1$ and $R_2$ represents hydrogen, alkyl, alicyclic, aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, $R_1$ may form a heterocyclic ring together with $R_2$, Z represents halogen, alkyl, halogenated alkyl, cyanoalkyl, alicyclic, hydroxyl, alkoxyl, phenoxyl, aralkyl, aryl, acyl, carboxyl, alkoxycarbonyl, amino, substituted amino or nitro and n is zero or an integer of 1 to 3; and

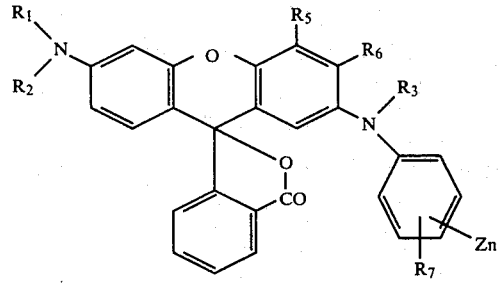

(III)

wherein each $R_1$, $R_2$ and $R_3$ represents hydrogen, alkyl, alicyclic aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, and $R_1$ may form a heterocyclic ring together with $R_2$; $R_5$ represents hydrogen, halogen, alkyl, halogenated alkyl, cyanoalkyl, alkoxyl, aralkyl or substituted amino; $R_6$ represents hydrogen, halogen, alkyl, halogenated alkyl, cyanoalkyl or aralkyl; $R_7$ represents halogen, carboxyl, alkoxycarbonyl or halogenated methyl; Z represents halogen, alkyl, halogenated alkyl, cyanoalkyl, alicyclic, alkoxyl, aralkyl, aryl, acyl, amino, substituted amino or nitro and n is zero or an integer of 1 to 3.

Preferred black color developing fluoran compounds are these represented by the above formula (II) or (III) wherein $R_1$ is hydrogen, $C_1$ to $C_4$ alkyl, substituted $C_1$ to $C_4$ alkyl having a substituent selected from the group consisting of halogen, hydroxyl, alkoxyl and cyano, $C_7$ to $C_{11}$ aralkyl or heterocyclic ring which is formed together with $R_2$. Above all, the compounds wherein $R_2$ is $C_1$ to $C_4$ alkyl, cyclohexyl, phenyl or substituted phenyl having a substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro are most preferable.

Among the compounds represented by the formula (I) but not having the basic skeleton as shown in any of the formulae (II) and (III) there are included:

3-diethylamino-6-methyl-7-mesidino-4',5'-benzofluoran,
3-diethylamino-6-methyl-7-benzylamino-4',5'-benzofluoran,
3-(N-methylanilino)-5,6-benzo-7-phenoxyphenylaminofluoran,
3-(N-methylanilino)-5,6-benzo-7-(O-methyl-phenoxyphenyl)aminofluoran,
3-(N-methylanilino)-5,6-benzo-7-(m-methoxy-phenoxyphenyl)aminofluoran,
3-(N-methyl-o-nitrophenyl)amino-5,6-benzo-7-phenoxyphenylamino-4'-methylfluoran,
3-(N-ethyl-o-methoxycarbonylphenyl)amino-5,6-benzo-7-phenoxyphenylaminofluoran,
3-α-naphthylamino-5,6-benzo-7-phenoxyphenylaminofluoran,
3-(N-benzylanilino)-5,6benzo-7-phenoxyphenylamino-3',4',5',6'-tetrachlorofluoran,
3-(N-benzyl-cyclohexylamino)-5,6-benzo-7-α-naphthylamino-4'-bromofluoran,
3-(N-methyl-cyclohexylamino)-5-chloro-6-methyl-7-anilinofluoran,
3-(N-p-methylbenzyl-cyclohexylamino)-5-methoxy-7-anilinofluoran,
3-(N-α-naphthylmethyl-cyclohexylamino)-7-nitrobenzylaminofluoran,
3-(N-methyl-cyclohexylamino)-7-anilino-4'-nitrofluoran,
3-diethylamino-7-piperidinofluoran,
2-methyl-3-ethylamino-5,6-benzo-7-anilinofluoran,
2-methoxy-3-dimethylamino-7-dimethylaminofluoran,
3-diethylamino-4-chloro-6-methyl-7-toluidinofluoran,
2-bromo-3-diethylamino-5,6-benzo-7-phenoxyphenylaminofluoran,
2-chloro-3-(N-methyltoluidino)-7-(p-n-butylanilino)-fluoran,
2-dimethylaminomethyl-3-diethylamino-5-methyl-7-(N-methylbenzylamino)-4'-dimethylaminofluoran,
2-chloro-3-diethylamino-7-benzylamino-4'-methylfluoran,
2-chloro-3-diethylamino-6-methyl-7-anilino-4'-benzilidenefluoran,
3-(N-methyl-phenoxyphenylamino)-5-methyl-7-(p-butylanilino)-4'-nitrofluoran,
3-(N-methyl-phenoxyphenylamino)-5,6-benzo-7-phenoxyphenylaminofluoran, 3-(N-methoxyethyl-phenoxyphenylamino)-5,6-benzo-7-α-naphthylamino-4',6'-dibromofluoran,
3-diethylamino-7-(α-phenylethylamino)fluoran,
3-diethylamino-6-methyl-7-(α-phenylethylamino)fluoran,
3-diethylamino-5-methyl-7-(α-phenylethylamino)fluoran,
3-diethylamino-5-chloro-7-(α-phenylethylamino)fluoran,
3-dimethylamino-7-(α-phenylethylamino)fluoran,
3-(N-ethyl-p-toluidino)-7-(α-phenylethylamino)fluoran,
3-(N-methylanilino)-7-(α-phenylethylamino)fluoran,
3-mesidino-7-(α-phenylethylamino)fluoran,
3-(N-methylxylidino)-6-methyl-7-cyclohexylaminofluoran,
3-(N-butyl-xylidino)-6-methyl-7-benzylaminofluoran,
3-di-(cyanoethyl)amino-6-methyl-7-xylidino-4',5'-benzofluoran,
3-(N-cyanoethyl)anilino-5,6-benzo-7-phenoxyphenylaminofluoran,
3-di-butylamino-6-methyl-7-cyanoethylanilino-4',5'-benzofluoran,
3-pyrrolidino-7-(di-p-chlorophenyl)methylaminofluoran,
3-pyrrolidino-7-(di-p-methylphenyl)methylaminofluoran,
3-pyrrolidino-5-methyl-7-(di-p-methylphenyl)methylaminofluoran,
3-pyrolidino-5-amino-7-(di-p-methylphenyl)methylaminofluoran,
3-methylpiperidino-7-(di-p-chlorophenyl)methylaminofluoran,
3-morpholino-5,6-benzo-7-anilinofluoran,
3-morpholino-5,6-benzo-7-anisidinofluoran,
3-(N-methyl-cyclohexylamino)-5,6-benzo-7-α-naphthylamino-4'-bromofluoran, and
3-(N-benzylcyclohexylamino)-5-chloro-7-α-naphthylamino-4'-chlorofluoran.

Among the fluoran compounds having a general formula (II), there are included:
3-diethylamino-6-methyl-7-anilinofluoran, 3-diethylamino-6-methyl-7-toluidinofluoran, 3-diethylamino-6-methyl-7-xylidinofluoran, 3-diethylamino-6-methyl-7-mesidino-fluoran, 3-diethylamino-6-methyl-7-(p-butylanilino)fluoran, 3-diethylamino-6-methyl-7-anisidinofluoran, 3-diethylamino-6-methyl-7-p-phenetidinofluoran, 3-dimethylamino-6-methyl-7-anilinofluoran, 3-dipropylamino-6-methyl-7-anilinofluoran, 3-di(β-ethoxyethyl)amino-6-methyl-7-anilinofluoran, 3-di(chloroethyl)amino-6-methyl-7-anilinofluoran, 3-dibenzylamino-6-methyl-7-anilinofluoran, 3-N-methylcyclohexylamino-6-methyl-7-anilinofluoran, 3-α-naphthylamino-6-methyl-7-anilinofluoran, 3-pyrrolidino-6-methyl-7-anilinofluoran, 3-piperidino-6-methyl-7-anilinofluoran, 3-piperidino-6-methyl-7-toluidinofluoran, 3-piperidino-6-methyl-7-(p-butylanilino)fluoran, 3-methylpiperidino-6-methyl-7-(p-butylanilino)fluoran, 3-morpholino-6-methyl-7-(p-butylanilino)fluoran, 3-(N-methylanilino)-6-methyl-7-anilinofluoran, 3-(N-ethyl-anilino)-6-methyl-7-anilinofluoran, 3-(N-benzyl-anilino)-6-methyl-7-anilinofluoran, 3-(N-ethyl-p-toluidino)-6-methyl-7-anilinofluoran, 3-(N-ethyl-p-chloroanilino)-6-methyl-7-anilinofluoran, 3-(N-ethyl-anilino)-6-methyl-7-(p-toluidino)fluoran, 3-(N-ethyl-p-toluidino)-6-methyl-7-(p-toluidino)fluoran, 3-N-benzyl-xylidino-6-methyl-7-(p-toluidino)fluoran, 3-(N-chloroethyl-p-toluidino)-6-methyl-7-xylidinofluoran, 3-N-ethyl-anilino-6-methyl-7-(p-butylanilino)fluoran and 3-dicyanoethyl)amino-6-methyl-7-anilinofluoran.

Among the fluorans having the general formula (III), there are included:
3-diethylamino-7-chloroanilinofluoran, 3-diethylamino-7-bromoanilinofluoran, 3-diethylamino-7-trifluoromethylanilinofluoran, 3-diethylamino-7-(N-methyl-trifluoromethylanilino)fluoran, 3-dimethylamino-7-trifluoromethylanilinofluoran, 3-dimethylamino-7-(N-methyl-trifluoromethylanilino)fluoran, 3-dimethylamino-7-(N-ethyl-trifluoromethylanilino)fluoran, 3-dimethylamino-7-(N-benzyl-trifluoromethylanilino)-fluoran, 3-diethylamino-5-methyl-7-trifluoromethylanilinofluoran, 3-diethylamino-5-ethyl-7-trifluoromethylanilinofluoran, 3-diethylamino-5-chloro-7-trifluoromethylanilinofluoran, 3-diethylamino-5-methyl-7-(N-methyl-trifluoromethylanilino)fluoran, 3-diethylamino-5-ethyl-7-(N-ethyl-trifluoromethylanilino)-fluoran, 3-diethylamino-5-chloro-7-(N-benzyl-trifluoromethylanilino)fluoran, 3-diethylamino-6-chloro-7-trifluoromethylanilinofluoran, 3-dipropylamino-7-trifluoromethylanilinofluoran, 3-diethylamino-7-(O-methoxycarbonylphenylamino)fluoran, 3-diethylamino-7-(O-carboxyphenylamino)fluoran, 3-di-n-butylamino-7-trifluoromethylanilinofluoran, 3-benzylamino-7-trifluoromethylanilinofluoran, 3-(N-methylanilino)-7-trifluoromethylanilinofluoran, 3-(N-ethyl-p-toluidino)-7-trifluoromethylanilinofluoran, 3-(N-ethyl-p-chloroanilino)-7-trifluoromethylanilinofluoran, 3-piperidino-7-trifluoromethylanilinofluoran, 3-pyrrolidino-7-trifluoromethylanilinofluoran, 3-morpholino-7-trifluoromethylanilinofluoran, 3-morpholino-7-(N-propyl-trifluoromethylanilino)fluoran, and 3-di-(cyanoethyl)amino-7-trifluoromethylanilinofluoran.

Black color basic dyes having skeletons other than the general formula (I) may also be jointly used, but the amount of such additional dyes should be limited to the extent which will not sacrifice the advantages obtained according to the invention. The amount of such additional dyes jointly used depends on the kind of dyes used and, therefore, though not necessarily limited, it is preferably less than 40% by weight and more preferably less than 10% by weight of the total amount of all the dyes. Further, the mixed use of dyes which develop color with other hue within the range which will not alter the black color developing hue of the invention is allowed.

Organic acceptors used in the present invention are of a nature such that they are electron acceptor of solid at the normal temperature and with increasing temperature they will be liquefied, gasified or melted and that they will develop color upon contact with previously mentioned basic dyes. Among them there are included aliphatic carboxylic acid such as oxalic acid, maleic acid, tartaric acid, citric acid, succinic acid and stearic acid; aromatic carboxylic acid such as benzoic acid, p-tert-butylbenzoic acid, phthalic acid, gallic acid, salicylic acid, 3-isopropylsalicylic acid, 3-cyclohexylsalicylic acid, 3,5-di-tert-butylsalicylic acid and 3,5-di-α-methylbenzylsalicylic acid; phenolic compounds such as 4,4'-isopropylidene-diphenol, 4,4'-isopropylidene-bis(2-chlorophenol), 4,4'-isopropylidene-bis(2,6-dibromophenol), 4,4'-isopropylidene-bis(2,6-dichlorophenol), 4,4'-isopropylidene-bis(2-methylphenol), 4,4'-isopropylidene-bis(2,6-dimethylphenol), 4,4'-isopropylidene-bis(2-tert-butylphenol), 4,4'-sec-butylidene-diphenol, 4,4'-cyclohexylidene-bisphenol, 4,4'-cyclohexylidene-bis(2-methylphenol), 4-tert-butylphenol, 4-phenylphenol, 4-hydroxy-diphenoxide, α-naphthol, β-naphthol, methyl-4-hydroxybenzoate, 4-hydroxyacetophenol, novolak type phenol resin, 2,2'-thio-bis(4,6-dichlorophenol), 4-tert-octylcatechol, 2,2'-methylene-bis(4-chlorophenol), 2,2'-methylene-bis(4-methyl-6-tert-butylphenol) and 2,2'-dihydroxy-diphenyl; and salts of these organic acceptor with a polyvalent metal such as zinc, magnesium, aluminum, calcium, titanium, manganese, tin and nickel.

Among the above organic acceptors, phenolic compounds are suitable for use, and particularly, multivalent phenolic compounds having at least two phenolic hydroxyl groups in each molecule are preferably used since they are excellent in retaining a good recording property for a long time and in showing a good sensitivity in recording. In addition, two or more of these organic acceptors may, of course, be mix-used.

The acceptor may also include inorganic acceptors such as activated clay, acid clay, attapulgite, bentonite, coloidal silica, aluminum silicate, magnesium silicate, zinc silicate, tin silicate, calcined kaolin and talc. Further, with the intention of improving color developability, delustering the record layer and improving writing quality, it is possible to jointly use inorganic metallic compounds and inorganic pigments of a nature such that they will develop little color, if any, upon contact with basic dyes. Such inorganic metallic compounds are oxides, hydroxides and carbonates of polyvalent metals, and mention may be made, for example, of zinc oxide, magnesium oxide, calcium oxide, barium oxide, aluminum oxide, tin oxide, magnesium hydroxide, aluminum hydroxide, calcium hydroxide, zinc hydroxide, tin hydroxide, magnesium carbonate, zinc carbonate and calcium carbonate. As for the inorganic pigments, mention may be made of kaolin, clay, barium sulfate, etc. The amount of such inorganic acceptors, inorganic metallic compounds and inorganic pigments to organic acceptors in joint use, though not particularly limited, may be generally, 0.1–5 parts by weight, preferably 0.2–2 parts by weight per part by weight of the organic acceptors.

In the heat-sensitive recording material of the invention the ratio between the basic dye and organic acceptor used in the color developing layer is not particularly limited, but it is usual to use a larger amount of acceptor than dye for reasons of cost, etc., and 1–50 parts by weight, preferably 4–10 parts by weight of organic acceptor per part by weight of basic dye is used.

The heat-sensitive recording material according to the present invention, as described above, contains in its color developing layer an acceptor and a basic dye containing at least two particular black color developing fluoran compounds. Thus, in order to form such color developing layer, two methods may be adopted; in one method the base sheet is coated with a coating composition having dispersed therein fine particles of a basic dye and fine particles of an acceptor, and in the other method the base sheet surface is double coated with two coating compositions having respectively dispersed therein a basid dye and an acceptor. However, various other methods may also be adopted, including impregnation, incorporation during the base sheet making process, application as a tonor, and coating separate base sheets with said substances and then putting the coated surfaces together. As for the coating composition for forming a color developing layer, water is used as a dispersion medium for dispersion of basic dye, acceptor, etc., by an agitating and pulverizing machine, such as a ball mill, attritor, sand grinder or the like to prepare the same.

In the coating composition a binder such as starches, hydroxyethylcellulose, methylcellulose, carboxymethylcellulose, gelatin, casein, gum arabic, polyvinyl alcohol, salts of styrenemaleic anhydride copolymers, styrene-butadiene copolymer emulsion, vinylacetate-maleic anhydride copolymer emulsion and salts of polyacrylic acid is used in an amount of 10 to 40% by weight, preferably 15 to 30% by weight with respect to the total solid amount.

In the coating composition various additives may also be added. Among the additives, for example, there are included dispersing agents such as sodium dioctylsulfosuccinate, sodium dodecylbenzenesulfonate, laurylsulfuric acid sodium salt and metal salts of fatty acid; ultraviolet ray absorbing agents such as benzophenone derivatives and triazol derivatives; heat fusible materials which may dissolve at least one of dyes and acceptors such as stearic acid amide and 2,6-diisopropylnaphthalene in order to improve color sensitivity at low temperature; defoaming agents; fluorescent dyes and coloring dyes. The coating composition may also contain dispersion or emulsion including stearic acid, polyethylene, carnauba wax, paraffin wax, zinc stearate, calcium stearate, ester wax in order to prevent the heat-sensitive record material from being stuck in contact with stylus of recording machine or recording head.

As for the base sheet, paper, plastic film, synthetic paper, woven fabric sheet and moldings may be used, but paper is used most preferably from the standpoint of cost, aptitude for coating, etc. Further, the amount of coating composition applied to form a color developing layer, though not particularly limited, usually is 2–12 g/m$^2$, preferably 3–10 g/m$^2$ by dry weight.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

(1) Preparation of A liquid:

The following composition was passed through a sand grinder.

| | |
|---|---|
| 3-(N-ethyl-p-toluidino)-6-methyl-7-anilino-fluoran | 1 part |
| stearic acid amide | 0.2 parts |
| 2% aqueous solution of hydroxyethyl-cellulose | 5 parts |

Pulverization was continued until an average particle size of 2 microns.

(2) Preparation of B liquid:

The following composition was passed through a sand grinder.

| | |
|---|---|
| 3-(N-ethyl-p-toluidino)-6-methyl-7-p-toluidinofluoran | 1 part |
| stearic acid amide | 0.2 parts |
| 2% aqueous solution of hydroxyethyl- | |

-continued

| | |
|---|---|
| cellulose | 5 parts |

Pulverization was continued until an average particle size of 2 microns.

(3) Preparation of C liquid:

The following composition was passed through a sand grinder.

| | |
|---|---|
| 4,4'-isopropylidene-diphenol | 10 parts |
| stearic acid amide | 2 parts |
| 2% aqueous solution of hydroxyethyl-cellulose | 50 parts |

Pulverization was continued until an average particle size of 2 microns.

(4) Making a heat-sensitive recording material:

The following components were mixed to prepare a coating composition.

| | |
|---|---|
| A liquid | 6.2 parts |
| B liquid | 6.2 parts |
| C liquid | 6.2 parts |
| very finely divided silica anhydride ("Syloid #244" manufactured by Fuji-Davison Chemical Company, Ltd.) | 5 parts |
| 20% aqueous solution of styrene-maleic anhydride copolymer | 35 parts |
| zinc stearate | 1 part |
| water | 20 parts |

The coating composition was coated on a base sheet of 50 g/m$^2$ in the weight of an amount of 8 g/m$^2$ on dry basis to obtain a heat-sensitive recording material.

Control 1

The (4) step of Example 1 was repeated except that 12.4 parts of A liquid was used instead of 6.2 parts of A liquid and 6.2 parts of B liquid to obtain a heat-sensitive recording material.

Control 2

The (4) step of Example 1 was repeated except that 12.4 parts of B liquid was used instead of 6.2 parts of A liquid and 6.2 parts of B liquid to obtain a heat-sensitive recording material.

The properties of the obtained three heat-sensitive recording materials were examined by the following methods. The test results are shown in Table 1.

(1) Fogging:

The optical density on the surface of a color developing layer before recording is measured at 580 nm with the use of spectrophotometer 204 (manufactured by Hitachi, Ltd.)

(2) Color Developability:

Each recording material was stayed on a heated plate at 125° C. for 5 seconds with a pressure of 4 kg/cm$^2$. The optical density (initial density) of the resultant color image was examined in the same manner as described above.

(3) Fading Ratio (humidity resistance):

After the color image obtained by the above color developability test was allowed to stand for 24 hours at 50° C. under 90% RH, the optical density (humidity resisting density) was examined in the same manner as described above.

$$\text{Fading Ratio (\%)} = \frac{\text{initial density} - \text{humidity resisting density}}{\text{initial density}} \times 100$$

(4) Fading Ratio (heat resistance):

After the color image obtained by the above color developability test was allowed to stand for 24 hours at 60° C., the optical density (heat resisting density) was examined in the same manner as described above.

$$\text{Fading ratio (\%)} = \frac{\text{initial density} - \text{heat resisting density}}{\text{initial density}} \times 100$$

TABLE 1

| | Fogging (optical density) | Color develop-ability (initial density) | Humidity Resistance (humidity resisting density) | Humidity Resistance fad-ing ratio | Heat Resistance heat resisting density | Heat Resistance fad-ing ratio |
|---|---|---|---|---|---|---|
| Example 1 | 0.03 | 0.93 | 0.82 | 12(%) | 0.89 | 4(%) |
| Control 1 | 0.03 | 0.92 | 0.23 | 75 | 0.59 | 36 |
| Control 2 | 0.02 | 0.93 | 0.25 | 73 | 0.58 | 38 |

As shown in Table 1, heat-sensitive recording material obtained in Example 1 according to the inention is not foggy, and is superior in both of humidity resistance and heat resistance.

EXAMPLES 2 TO 8 AND CONTROLS 3 TO 6

(1) Preparation of A liquid:

The following composition was passed through a sand grinder.

| | |
|---|---|
| mixture of 3-(N-methyl-p-toluidino)-6-methyl-7-anilinofluoran with 3-(N-ethylanilino)-6-methyl-7-(p-toluidino)fluoran as shown in Table 2 | 2 parts |
| 5% aqueous solution of polyvinyl alcohol ("PVA 117" manufactured by Kuraray Co., Ltd.) | 10 parts |
| water | 8 parts |

Pulverization was continued until an average particle size of 2 microns.

(2) Preparation of B liquid:

The following composition was passed through a sand grinder.

| | |
|---|---|
| 4,4'-isopropylidene-diphenol | 8 parts |
| 4,4'-sec-butylidene-bisphenol | 2 parts |
| stearic acid amide | 3 parts |
| polyvinylalcohol ("PVA 117" manufactured by Kuraray Co., Ltd.) | 50 parts |
| water | 40 parts |

Pulverization was continued until an average particle size of 2 microns.

(3) Making a heat-sensitive recording material:

The following components were mixed to prepare a coating composition:

| | |
|---|---|
| A liquid | 18 parts |
| B liquid | 103 parts |
| calcined clay ("Satenton #5" manufactured by Engelhard Minerals & Chemicals Corporation) | 5 parts |
| very finely divided silica anhydride ("Syloid #266" manufactured by Fuji-Davison Chemical Company, Ltd.) | 5 parts |
| fluorescent dye ("Whitex BB conc" manufactured by Sumitomo Chemical Ind.) | 0.01 parts |
| water | 40 parts |

Each coating composition was coated on a base sheet of 50 g/m$^2$ in the weight of an amount of 8 g/m$^2$ on dry basis to obtain eleven heat-sensitive recording materials. The properties of those heat-sensitive recording materials were examined in the same manner as in Example 1. The test results are shown in Table 2.

Each heat-sensitive recording material obtained in Examples according to the invention is not foggy and produces a superior color image in humidity resistance and heat resistance as shown in Table 2. Additionally, the heat-sensitive recording materials were pressed with a heated plate at a temperature gradient to develop color images on the surfaces. The produced color images on the heat-sensitive recording materials obtained in Examples have color densities corresponding to the temperature gradient which are superior in color continuous gradation.

TABLE 2

| | Basic Dyes | | Mixing Ratio | Fogging (optical | Color develop-ability (initial | Fading Ratio(%) | |
|---|---|---|---|---|---|---|---|
| | A* | B* | A/B | density) | density) | humidity resistance | heat resis-tance |
| Example 2 | 1.8 | 0.2 | 90/10 | 0.04 | 1.32 | 59 | 13 |
| Example 3 | 1.4 | 0.6 | 70/30 | 0.03 | 1.33 | 41 | 11 |
| Example 4 | 1.2 | 0.8 | 60/40 | 0.04 | 1.33 | 19 | 8 |
| Example 5 | 1.0 | 1.0 | 50/50 | 0.04 | 1.34 | 13 | 5 |
| Example 6 | 0.8 | 1.2 | 40/60 | 0.03 | 1.32 | 18 | 6 |
| Example 7 | 0.6 | 1.4 | 30/70 | 0.04 | 1.33 | 37 | 10 |
| Example 8 | 0.2 | 1.8 | 10/90 | 0.03 | 1.32 | 65 | 15 |
| Control 3 | 0.1 | 1.9 | 5/95 | 0.04 | 1.31 | 89 | 41 |
| Control 4 | 1.9 | 0.1 | 95/5 0.03 | 1.32 | 88 | 36 | |
| Control 5 | 2.0 | 0 | — | 0.03 | 1.32 | 88 | 39 |
| Control 6 | 0 | 2.0 | — | 0.04 | 1.31 | 87 | 37 |

(Note)*
A: 3-(N-methyl-p-toluidino)-6-methyl-7-anilinofluoran
B: 3-(N-ethylanilino)-6-methyl-7-(p-toluidino)fluoran.

EXAMPLES 9 TO 15 AND CONTROLS 7 TO 9

Example 2 was repeated except that the mixtures of 3-(N-methyl-p-toluidino)-6-methyl-7-anilinofluoran, 3-(N-ethyl-anilino)-6-methyl-7-(p-toluidino)fluoran and 3-diethylamino-7-m-trifluoromethylanilinofluoran were used as basic dyes as shown in Table 3 to produce the heat-sensitive recording materials. The properties of the heat-sensitive recording materials were examined as in the same manner as in Example 1. The test results are shown in Table 3.

The heat-sensitive recording materials obtained in Examples according to the invention are not foggy and produce stable color images superior in humidity resistance and heat resistance.

TABLE 3

| | Basic Dyes | | | Fogging (optical | Color develop-ability (initial | Fading Ratio (%) | |
|---|---|---|---|---|---|---|---|
| | A* | B* | C* | density | density | humidity resistance | heat resistance |
| Example 9 | 1.4 | 0.4 | 0.2 | 0.03 | 1.28 | 15 | 8 |
| Example 10 | 0.3 | 1.4 | 0.3 | 0.03 | 1.26 | 18 | 6 |
| Example 11 | 0.1 | 0.5 | 1.4 | 0.04 | 1.22 | 13 | 7 |
| Example 12 | 1.0 | 0.5 | 0.5 | 0.03 | 1.29 | 7 | 2 |
| Example 13 | 0.6 | 0.8 | 0.6 | 0.04 | 1.29 | 5 | 3 |
| Example 14 | 0.5 | 0.7 | 0.8 | 0.04 | 1.25 | 3 | 2 |
| Example 15 | 0.5 | 0.5 | 1.0 | 0.03 | 1.26 | 5 | 2 |
| Control 7 | 1.9 | 0.05 | 0.05 | 0.04 | 1.28 | 91 | 27 |
| Control 8 | 0.05 | 1.9 | 0.05 | 0.03 | 1.29 | 90 | 28 |
| Control 9 | 0.05 | 0.05 | 1.9 | 0.03 | 1.25 | 90 | 22 |

(Note)*
A: 3-N-methyl-p-toluidino)-6-methyl-7-anilinofluoran
B: 3-(N-ethylanilino)-6-methyl-7-(p-toluidino)fluoran
C: 3-diethylamino-7-m-trifluoromethylanilinofluoran

EXAMPLES 16 TO 30 AND CONTROL 10

(1) Preparation of A liquid:

| | |
|---|---|
| A ball mill was loaded with the following composition | |
| basic dyes as shown in Table 4 | 0.3 parts |
| 2% aqueous solution of hydroxyethyl-cellulose | 10 parts |

Pulverization was continued until an average particle size of 3 microns.

(2) Preparation of B liquid:

| | |
|---|---|
| A ball mill was loaded with the following composition | |
| 3-(N-ethyl-p-toluidino)-6-methyl-7-anilino-fluoran | 2 parts |
| 2% aqueous solution of hydroxyethyl-cellulose | 10 parts |

Pulverization was continued until an average particle size of 3 microns.

(3) Preparation of C liquid:

| | |
|---|---|
| A ball mill was loaded with the following composition | |
| 4,4'-isopropylidene-diphenol | 8.5 parts |
| 4,4'-cyclohexylidene-diphenol | 1.5 parts |
| stearic acid amide | 4 parts |
| 2% aqueous solution of hydroxyethyl-cellulose | 50 parts |

Pulverization was continued until an average particle size of 3 microns.

(4) Making a heat-sensitive recording material:

The following components were mixed to prepare a coating composition:

| | |
|---|---|
| A liquid | 12 parts |
| B liquid | 12 parts |
| C liquid | 64 parts |
| very finely divided silica anhydride ("Syloid #266" manufactured by Fuji-Davison Chemical) | 10 parts |
| 20% aqueous solution of styrene-maleic anhydride copolymer | 40 parts |
| water | 22 parts |

Each coating composition were coated on a base sheet of 50 g/m$^2$ in the weight of an amount of 8 g/m$^2$ on dry basis to obtain sixteen heat-sensitive recording materials. The properties of those heat-sensitive recording materials were examined in the same manner as in Example 1. The test results are shown in Table 4.

TABLE 4

| | Basic Dyes | Fogging (optical density) | Color Develop-ability (initial density) | Fading Ratio (humidity resistance) |
|---|---|---|---|---|
| Example 16 | 3-diethylamino-6-methyl-7-anilinofluoran | 0.10 | 1.26 | 48 (%) |
| Example 17 | 3-diethylamino-6-methyl-7-xylidinoluoran | 0.09 | 1.25 | 45 |
| Example 18 | 3-diethylaminono-6-methyl-7-(2-methoxy-carbonylanilino)fluoran | 0.09 | 1.28 | 47 |
| Example 19 | 3-diethylamino-6-methyl-7-(2-carboxyanilino) fluoran | 0.10 | 1.27 | 49 |
| Example 20 | 3-diethylamino-6-methyl-7-p-phenetidinofluoran | 0.09 | 1.26 | 52 |
| Example 21 | 3-diethylamino-6-methyl-7-p-butylanilinofluoran | 0.09 | 1.29 | 46 |
| Example 22 | 3-diethylamino-7-(m-trifluoromethyl)anilinofluo-ran | 0.04 | 1.27 | 50 |
| Example 23 | 3-diethylanino-7-chloroanilinofluoran | 0.05 | 1.28 | 47 |
| Example 24 | 3-(N-methyl-cyclohexylamino)-6-methyl-7-anilinofluoran | 0.13 | 1.25 | 45 |
| Example 25 | 3-piperidino-6-methyl-7-anilinofluroan | 0.13 | 1.24 | 46 |
| Example 26 | 3-pyrrolidino-6-methyl-7-anilinofluoran | 0.11 | 1.27 | 47 |
| Example 27 | 3-piperidino-6-methyl-7-p-butylanilinofluoran | 0.12 | 1.28 | 49 |
| Example 28 | 3-piperidino-6-methyl-7-toluidinofluoran | 0.12 | 1.26 | 47 |
| Example 29 | 3-(N-ethyl-p-toluidino)-6-methyl-7-p-toluidino-fluoran | 0.03 | 1.28 | 49 |
| Example 30 | 3-(N-methyl-p-toluidino)-6-methyl-7-p-butylanilinofluoran | 0.03 | 1.25 | 51 |
| Control 10 | 3-(N-ethyl-p-toluidino)-6-methyl-7-anilinofluoran | 0.03 | 1.26 | 37 |

What we claim is:

1. In a black color developing heat-sensitive recording material comprising a base sheet and a color developing layer formed on at least one surface of the base sheet, said color developing layer including colorless or light-colored chromogenic material and acceptor which is reactive with said chromogenic material to develop a black color, an improvement that at least 60% by weight of said chromogenic material comprises at least two kinds of black color developing fluoran compounds having the same blackish hue and having the general formula

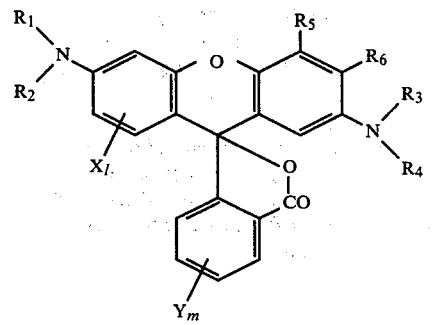

(I)

where each $R_1$, $R_2$, $R_3$ and $R_4$ represents hydrogen, alkyl, alicyclic, aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, $R_1$ may cooperate with $R_2$ to form a heterocyclic ring and $R_3$ may cooperate with $R_4$ to form a heterocyclic ring; $R_5$ represents hydrogen, halogen, alkyl, halogenated alkyl, cyanoalkyl, alkoxyl, aralkyl or substituted amino; $R_6$ represents hydrogen, halogen, alkyl, halogenated alkyl, cyanoalkyl or aralkyl; $R_5$ may cooperate with $R_6$ to form an aromatic ring; X represents halogen, alkyl, halogenated alkyl, cyanoalkyl or alkoxyl; Y represents halogen, alkyl, alicyclic, halogenated alkyl, cyanoalkyl, alkoxyl, aralkyl, aryl, acyl, amino, substituted amino or nitro; Y may form an aromatic ring together with the benzene ring to which Y is attached; l is zero or an integer of 1 to 2 and m is zero or an integer of 1 to 4, and the amount of each of said black color developing fluoran compounds is not larger than 90% by weight of the total amount of said black color developing fluoran compounds.

2. A black color developing heat-sensitive recording material according to claim 1, in which said acceptor comprises a phenolic compound.

3. A black color developing heat-sensitive recording material according to claim 2, in which said phenolic compound is a polyvalent phenolic compound having at least two phenolic hydroxide radicals.

4. A black color developing heat-sensitive recording material according to claim 1, in which at least 90% by weight of said chromogenic material consists of a plurality of black color developing fluoran compounds having the general formula (I) as defined in claim 1.

5. A black color developing heat-sensitive recording material according to claim 1, in which each of said black color developing fluoran compounds has the following general formula (II):

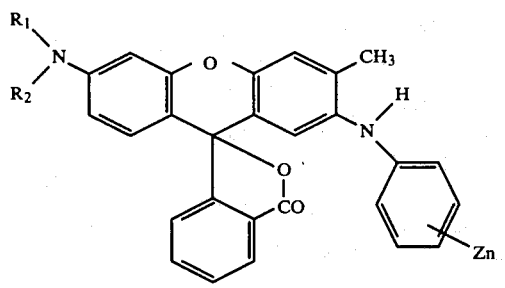

(II)

wherein each of $R_1$ and $R_2$ represents hydrogen, alkyl, alicyclic, aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, $R_1$ may form a heterocyclic ring together with $R_2$, Z represents halogen, alkyl, halogenated alkyl, cyanoalkyl, alicyclic, hydroxyl, alkoxyl, phenoxyl, aralkyl, aryl, acyl, carboxyl, alkoxycarbonyl, amino, substituted amino or nitro and n is zero or an integer of 1 to 3.

6. A black color developing heat-sensitive recording material according to claim 5, in which said acceptor comprises a phenolic compound.

7. A black color developing heat-sensitive recording material according to claim 6, in which said phenolic compound is a polyvalent phenolic compound having at least two phenolic hydroxide radicals.

8. A black color developing heat-sensitive recording material according to claim 5, in which at least 90% by weight of said chromogenic material consists of a pluraity of black color developing fluoran compounds having the general formula (II) as defined in claim 5.

9. A black color developing heat-sensitive recording material according to claim 1, in which said black color developing fluoran compounds has the following general formula (III):

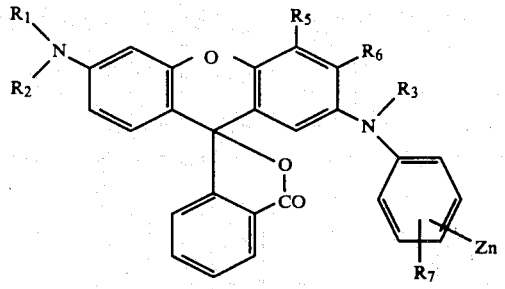

(III)

wherein each $R_1$, $R_2$ and $R_3$ represents hydrogen, alkyl, alicyclic, aryl or aralkyl, each of which may have at least one substituent selected from the group consisting of halogen, alkyl, halogenated alkyl, cyanoalkyl, alicyclic, aryl, aralkyl, hydroxyl, alkoxyl, phenoxyl, acyl, carboxyl, alkoxycarbonyl, amino, substituted amino, cyano and nitro, and $R_1$ may form a heterocyclic ring together with $R_2$; $R_5$ represents hydrogen, halogen, alkyl, halogenated alkyl, cyanoalkyl, alkoxyl, aralkyl or substituted amino; $R_6$ represents hydrogen, halogen, alkyl, halogenated alkyl, cyanoalkyl or aralkyl; $R_7$ represents halogen, carboxyl, alkoxycarbonyl or halogenated methyl; Z represents halogen, alkyl, halogenated alkyl, cyanoalkyl, alicyclic, alkoxyl, aralkyl, aryl, acyl, amino substituted amino or nitro and n is zero or an integer of 1 to 3.

10. A black color devloping heat-sensitive recording material according to claim 9, in which said acceptor comprises a phenolic compound.

11. A black color developing heat-sensitive recording material according to claim 10, in which said phenolic compound is a polyvalent phenolic compound having at least two phenolic hydroxide groups.

12. A black color developing heat-sensitive recording material according to claim 9, in which at least 90% by weight said chromogenic material consists of a plurality of black color developing fluoran compounds having the general formula (III) as defined in claim 9.

* * * * *